US005237742A

United States Patent [19]

McClune

[11] Patent Number: 5,237,742

[45] Date of Patent: Aug. 24, 1993

[54] METHOD OF PRODUCING ELECTRICAL CONTACT SOCKET

[75] Inventor: Donald W. McClune, Hollidaysburg, Pa.

[73] Assignee: Elco Corporation, Huntingdon, Pa.

[21] Appl. No.: 854,208

[22] Filed: Mar. 20, 1992

Related U.S. Application Data

[62] Division of Ser. No. 677,778, Mar. 29, 1991, Pat. No. 5,151,056.

[51] Int. Cl.[5] ..... H01R 43/04

[52] U.S. Cl. ..... 29/882; 29/874; 29/885

[58] Field of Search ..... 29/874, 882, 875, 885

[56] References Cited

U.S. PATENT DOCUMENTS

| | | | |
|---|---|---|---|
| 3,309,761 | 3/1967 | Deakin | 29/882 X |
| 4,918,813 | 4/1990 | Mori et al. | 29/874 |
| 5,067,916 | 11/1991 | Denlinger et al. | 29/885 X |
| 5,077,893 | 1/1992 | Mosquera et al. | 29/874 X |

FOREIGN PATENT DOCUMENTS

| | | | |
|---|---|---|---|
| 3935568 | 4/1986 | Fed. Rep. of Germany | 29/885 |
| 57-52530 | 3/1982 | Japan | 29/882 |
| 1026212 | 6/1983 | U.S.S.R. | 29/885 |
| 1398169 | 6/1975 | United Kingdom | 29/882 |

*Primary Examiner*—Carl J. Arbes

*Attorney, Agent, or Firm*—Spensley Horn Jubas & Lubitz

[57] ABSTRACT

A low insertion force, high contact force, electrical contact system, for use in a disk drive unit or printed circuit board, comprised of a socket contact and an insertion pin. The socket contact is provided with a mating region and a retention region. The mating region is formed of two independent opposed cantilevered contact beams embossed with contact dimples on their inwardly facing surfaces for engaging electrical pins. The cantilevered contact beams extend away from the retention region toward a pin-receiving end, and are angled inwardly toward each other to form a "flask" shape. Constant insertion forces are maintained on an insertion pin by the frictional forces produced by the embossed contact dimples. With a pin fully inserted into the socket contact, efficient mechanical and electrical contact is achieved by virtue of the compression and torsional forces produced by the independent cantilevered contact beams.

1 Claim, 4 Drawing Sheets

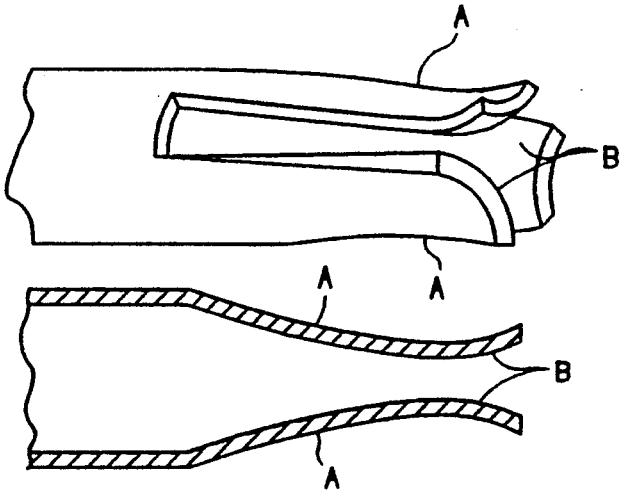
FIG. 1a
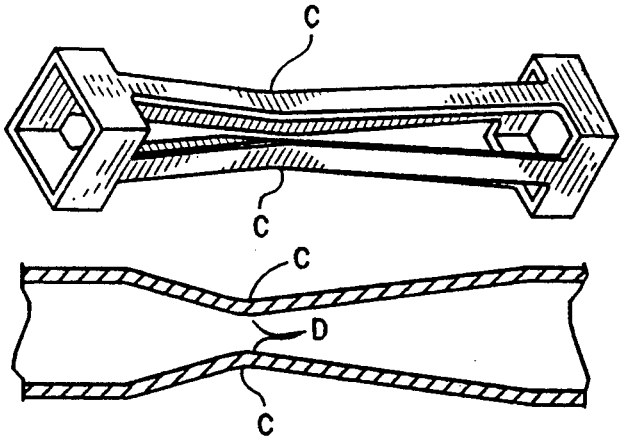
FIG. 1b
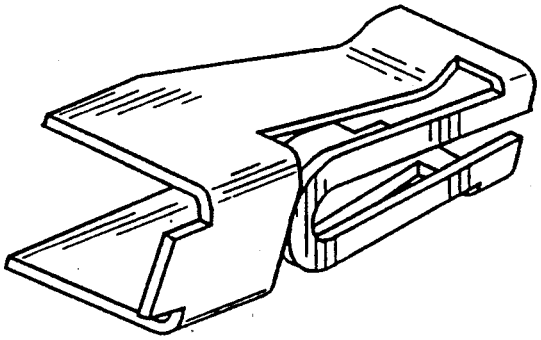
FIG. 1c
FIG. 1
PRIOR ART

METHOD OF PRODUCING ELECTRICAL CONTACT SOCKET

This is a division of application Ser. No. 07/677,778, filed on Mar. 29, 1991, now U.S. Pat. No. 5,151,056, issued Sep. 29, 1992.

BACKGROUND OF THE INVENTION

1. Field of the Invention

This invention relates to an electrical contact system particularly useful in printed circuit board applications. More particularly, this invention relates to a socket contact structure which allows for increased durability and reliability over many contact cycles, decreased centerline spacing to accommodate high density connectivity requirements, and improved socket-to-pin contact.

2. Related Prior Art

Electrical connectors utilizing pin-receiving sockets are widely used in the electronics industry for electrically connecting circuit members. Socket-to-pin contacts are used in printed circuit board applications that require robust, high density connectors.

A continuing objective of the electronics industry has been to make smaller, stronger, more reliable and more durable electrical connectors. Durability of a connector is measured in terms of contact cycles. The contact area of a socket must be capable of withstanding the forces produced by repeated insertions of a contact pin. Additionally, high density pin arrangements require narrow centerline spacing between adjacent pins. Socket contacts must accommodate high density pin arrays without loss in strength or durability. The prior art discloses a variety of socket contact structures as shown in FIG. 1.

Socket contacts typically use elongated spring tines to receive and engage the outer periphery of cylindrical pin contacts. U.S. Pat. No. 4,734,064 entitled "Electrical Socket Contact With Convex Engaging Tines", issued Mar. 29, 1988 to Knapp et al., is an example of a "tulip-shaped" socket contact. This socket contact is depicted in FIG. 1*a*. Cantilevered tines A are bent to form a tulip-shaped entry for receiving contact pins with the convex portion B of each tine engaging the pin contact. Although convex tines reduce wear on contact pins and assist in pin alignment, they are difficult to manufacture.

U.S. Pat. No. 4,379,611 entitled "Connector With Low Force Socket Contact Having An Integral Hood", issued Apr. 12, 1983 to Foege et al., similarly discloses a connector receptacle with cantilevered tines bent into a convex shape at their pin-receiving ends. The tines are not initially angled inward and pose manufacturing problems similar to those presented by the Knapp disclosure.

The prior art also discloses socket contacts using both "box-shaped" and "U-shaped" pin receptacles. U.S. Pat. No. 4,874,338 entitled "Receptacle Box Terminal With Improved Contact Area", issued Oct. 17, 1989 to Bakermans, is an example of a box-shaped pin receptacle. This socket contact structure is depicted in FIG. 1*b*. Each beam C of the receptacle box is embossed with a contact "dimple" D to engage a contact pin. The beams are not cantilevered.

U.S. Pat. No. 4,907,990 entitled "Elastically Supported Dual Cantilever Beam Pin-Receiving Electrical Contact", issued Mar. 13, 1990 to Bertho et al., is an example of a U-shaped pin receptacle. This socket contact structure is depicted in FIG. 1*c*. The cantilever beams E are bent at their free ends in a convex shape to engage the pin contact. U.S. Pat. No. 4,750,889 also discloses a U-shaped receptacle having cantilevered arms each having a contact point formed by a bend in the tip of the arms. The cantilevered arms are not initially angled inward.

The prior art discloses various techniques for forming constant and distinct contact points between the socket and inserted contact pin. Typically this is accomplished by either using embossed contact domes or "dimples", or by bending cantilever arms at the pin receiving ends. French patent 960,968 discloses an electrical contact having three sides, all of which have spherical contact dimples at the pin-receiving ends. U.S. Pat. No. 4,383,724 similarly discloses an electrical contact utilizing contact dimples. However, the prior art does not disclose cantilevered tines embossed with contact dimples.

Other designs disclose contact points formed by bending the tips of cantilevered arms. Variations of this technique have been suggested as evidenced by those disclosed in U.S. Pat. Nos. 4,232,931; 4,466,684; 4,473,269; and 4,529,260. This prior art does not disclose the use of contact dimples.

In order to remedy the deficiencies of the prior art, it is an object of the present invention to provide an electrical socket contact which is easily manufactured, highly durable and reliable. It is also an object of this invention to provide an electrical socket contact which permits tight centerline spacing of electrical components, decreased contact cavity size, and constant pin insertion force. In accordance with this and other objects, the present invention teaches the use of a combination of dimpled cantilever opposed beams initially angled inward to provide a torsional and compressional normal force on an inserted contact pin.

SUMMARY OF THE INVENTION

The present invention relates to a contact system for use in a disk drive unit or printed circuit board. The invention accomplishes a reduction in centerline spacing of pin contacts, while providing socket contacts with increased durability and reliability. More specifically, a reduction in centerline spacing is accomplished by decreasing the size of the socket contact cavity. The invention comprises a socket contact which is easily manufactured yet highly durable.

In the preferred embodiment of the present invention, the socket contact compresses two regions—a retention region and a mating region. The retention region has a generally U-shaped configuration with retention clips for engaging a receptable, such as a multi-contact insulating connector shell. The mating region is formed of two independent opposed cantilever contact beams and a spacing contact beam. The opposed cantilever beams are initially angled inward in a "flask" shaped arrangement. When a contact pin is inserted into the mating region, the cantilever beams open from their original flask shape to a "U" shape so that the mating region can accommodate the incoming pin.

Each contact beam is embossed with a spherical or cylindrical contact projection, or "dimple", which engages the outer periphery of an inserted pin. The dimples on the contact beams create a constant mating area with an inserted pin. This mating area ensures that constant force is maintained on the pin throughout an entire pin-to-socket insertion.

The structure of the two cantilever contact beams and the spacing contact beam permits efficient contact between the pin and the contact dimples by virtue of the compression and torsional moment of the two opposed contact beams. Small, durable and reliable electrical contacts are taught by the present invention which uses a combination of dimpled cantilevered arms initially angled inward.

Further aspects of the present invention will become apparent from the following detailed description when considered in conjunction with the accompanying drawings. It should be understood, however, that the detailed description and the specific examples, while representing the preferred embodiment of the invention, are given by way of illustration only.

DESCRIPTION OF THE DRAWINGS

FIG. 1*a* is a cross-sectional and perspective view of a "tulip-shaped" socket contact made according to the prior art.

FIG. 1*b* is a cross-sectional and perspective view of a "box-shaped" socket contact made according to the prior art.

FIG. 1*c* is a rear perspective view of a "U-shaped" socket contact made according to the prior art.

Like reference characters and designations in the drawings refer to like elements.

DETAILED DESCRIPTION OF THE INVENTION

The following description is of the best presently contemplated modes of carrying out the invention. This description is made for the purpose of illustrating the general principles of the invention and should not be taken in a limiting sense.

Figure 2:
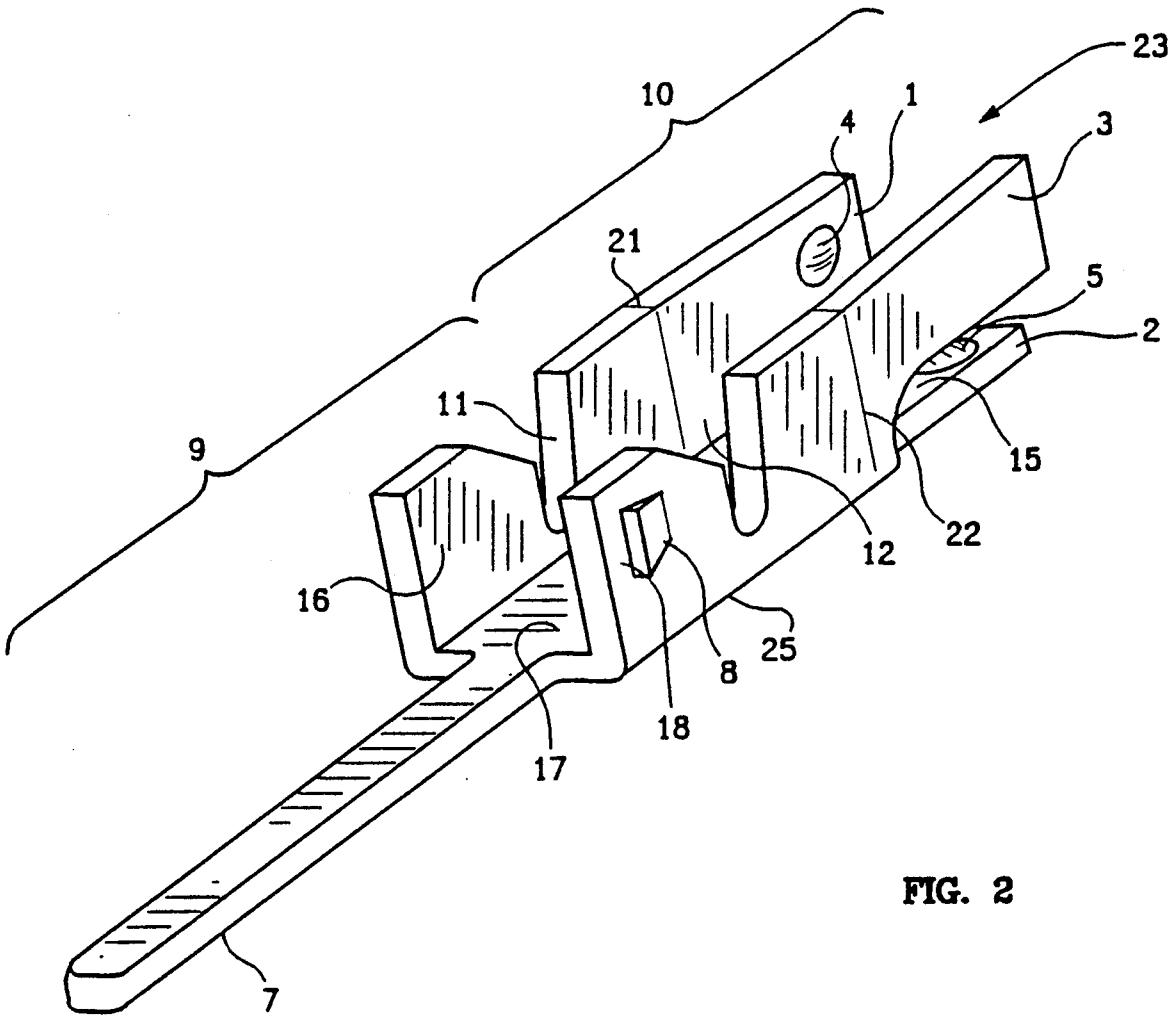
FIG. 2 is a rear perspective view of a pin-receiving socket contact made in accordance with the preferred embodiment of the present invention.

FIG. 2 depicts an electrical socket contact utilizing the dimpled opposed cantilevered contact beams of the present invention. The socket contact consists of a mating region 10 and a retention region 9.

The mating region 10 is formed of two opposed cantilevered contact beams 1, and 3 spaced apart by a spacing contact beam 2. The opposed contact beams 1, 3 are initially angled inward in a "flask" shaped arrangement and extend forward from the retention region 9 to a pin-receiving end 23. Both cantilevered contact beams 1, 3 and the spacing contact beam 3 are provided with an inwardly facing convex contact projection, or "dimple", 4, 6 and 5 (see FIG. 3*a*), respectively, adjacent the pin-receiving end 23. The maximum distance between the contact surfaces of the opposing dimples 4, 6 is less than the diameter or thickness of an electrical pin. Each mating beam 1, 2, 3 preferably has its dimple spaced a short distance from the pin-receiving end 23.

Opposed contact beams 1 and 3 are initially biased inwardly towards each other along transition lines 21 and 22, respectively. A compliance slot 15 separates contact beams 2 and 3. A similar compliance slot 14 (not shown) separates contact beams 1 and 2. The compliance slots 14 and 15 define the contact beams 1, 2, and 3 and make the contact beams more compliant to pin insertions.

Figure 4A:
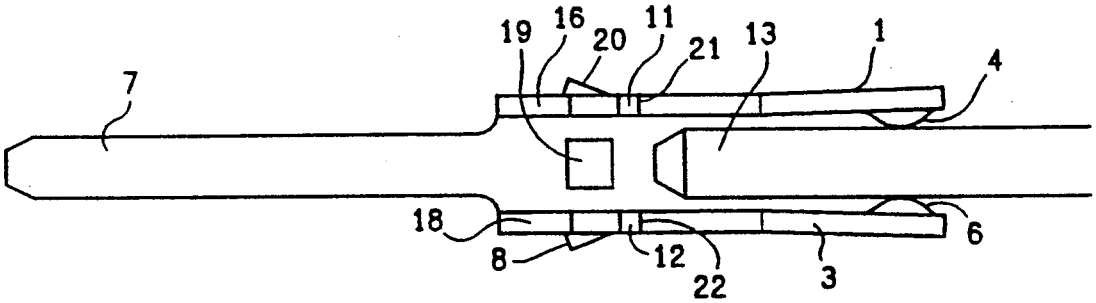
FIG. 4*a* is a top plan view of the preferred embodiment of the present invention shown after pin insertion.
Figure 4B:
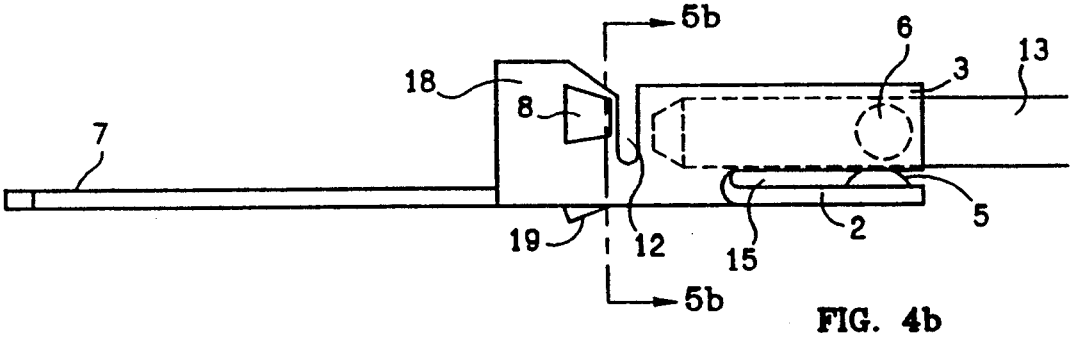
FIG. 4*b* is a side plan view of the preferred embodiment of the present invention shown after pin insertion.

The retention region 9 has a generally U-shaped configuration including a main section 17 integrally attached to a retention stake 7 extending outwardly from the retention region 9. A pair of spaced apart upstanding side legs 16, 18 extend approximately perpendicular to the main section 17 to an upper free end. Retention clips 20, 19 (see FIGS. 4*a* and 4*b*) are attached to legs 16, 17, 18, respectively, and extend outwardly at angles acute to the planes defined by the main section 17 and legs 16, 18, ending at outer free ends. The retention region 9 retains the socket contact in a receptacle such as an insulating connector shell (not shown) for use in a printed wiring board or in a disk drive unit.

The mating region 10 is separated from the retention region 9 by slots 11 and 12. The separation resulting from slots 11 and 12 isolates the function of the mating region 10 from the function of the retention region 9.

Figure 3A:
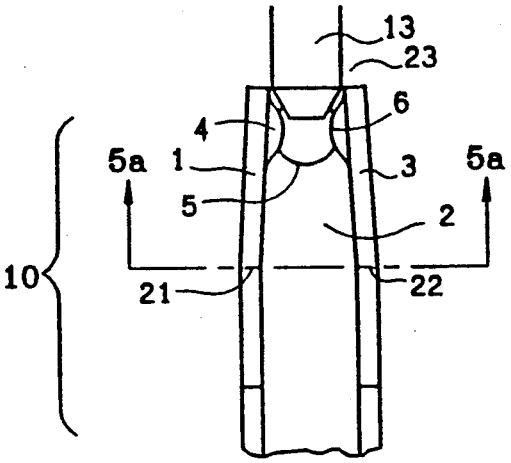
FIG. 3*a* is a top plan view of the mating region of the present invention shown prior to pin insertion.

As shown in FIGS. 3–5, the present invention facilitates pin insertions by providing a highly durable and reliable socket contact. More particularly, in the preferred embodiment shown in FIG. 3*a*, to insert a pin into the socket contact mating region 10, the insertion end of an electrical pin 13 is positioned adjacent the pin-receiving end 23. The contact beams 1, 2, and 3 have their dimples 4, 5, and 6, respectively, positioned such that when a pin 13 enters the pin-receiving end 23, the pin 13 first encounters the contact dimples. This configuration assists in proper pin alignment with the socket contact.

As the pin 13 is inserted into the mating region 10, the opposed contact beams 1, 3 are forced outwardly in a direction away from the inserted pin 13. Once the opposed contact beams 1, 3 are initially displaced, the pin 13 encounters only the contact dimples 4, 5, 6, embossed on each contact beam 1, 2, 3, respectively, and thus encounters only constant frictional forces from the contact dimples 4, 5, 6.

This configuration reduces insertion forces and enhances the mechanical durability of the socket contact.

Figure 3B:
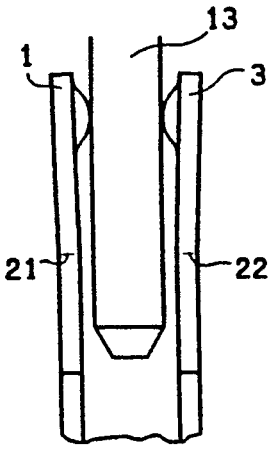
FIG. 3*b* is a top plan view of the mating region of the present invention shown after pin insertion.

FIG. 3*b* shows a top plan view of the socket contact mating region 10 with a pin 13 fully inserted. The opposed contact beams 1, 3 maintain constant contact with inserted pin 13 at contact dimples 4 and 6, respectively. Mechanical and electrical contact is maintained by virtue of the compression and torsional moments of opposed contact beams 1 and 3. More specifically, contact beam 1 produces a torsional moment about transition line 21 which exhibits a compressional force on dimple 4 normal to the sides of the pin 13. Similarly, contact beam 3 produces a torsional moment about transition line 22 which exhibits a compressional force on dimple 6 normal to the opposite side of the pin 13. In addition, as the pin 13 spreads the cantilevered contact beams 1 and 3 apart, they "pivot" about their attachment points to the main body of the socket contact, thus providing additional compressioned forces normal to the sides of the pin 13. As can be seen in more detail in FIGS. 4*a* and 4*b*, the spacing contact beam 2 maintains electrical and mechanical contact with an inserted pin 13 via contact dimple 5. This configuration provides a redundant high normal force contact which is both mechanically and electrically reliable.

Figure 5A:
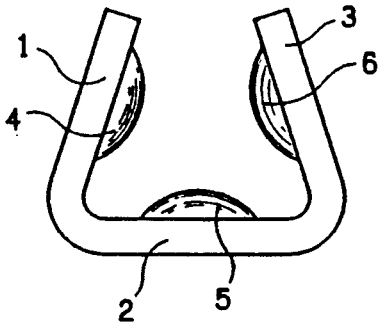
FIG. 5*a* is a cross-sectional view along line AA of FIG. 3*a* shown prior to pin insertion.
Figure 5B:
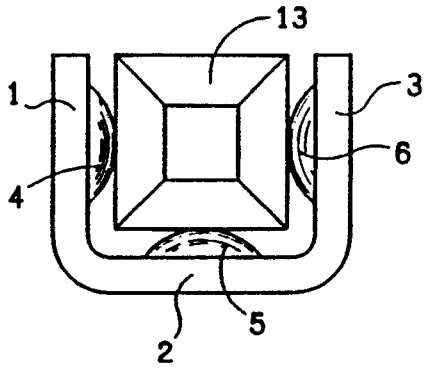
FIG. 5*b* is a cross-sectional view along line AA of FIG. 4*b* shown after pin insertion.

FIG. 5*a* shows a cross-sectional view along line AA of FIG. 3*a*, prior to pin insertion. As noted above, prior to pin insertion, contact beams 1, 2, 3 form a flask shape, with opposing contact beams 1 and 3 initially angled inward towards each other. FIG. 5*b* shows a cross-sectional view along line AA after a pin 13 is inserted into the socket contact. The opposed contact beams 1 and 3 "roll" open from their original flask shape to a "U" shape so that the mating region 10 can accommodate the incoming pin. The resulting compression from the opposed contact beams 1 and 3 against the sides of the inserted pin 13 provides enhanced mechanical and electrical contact between the pin 13 and the socket contact.

Figure 6:
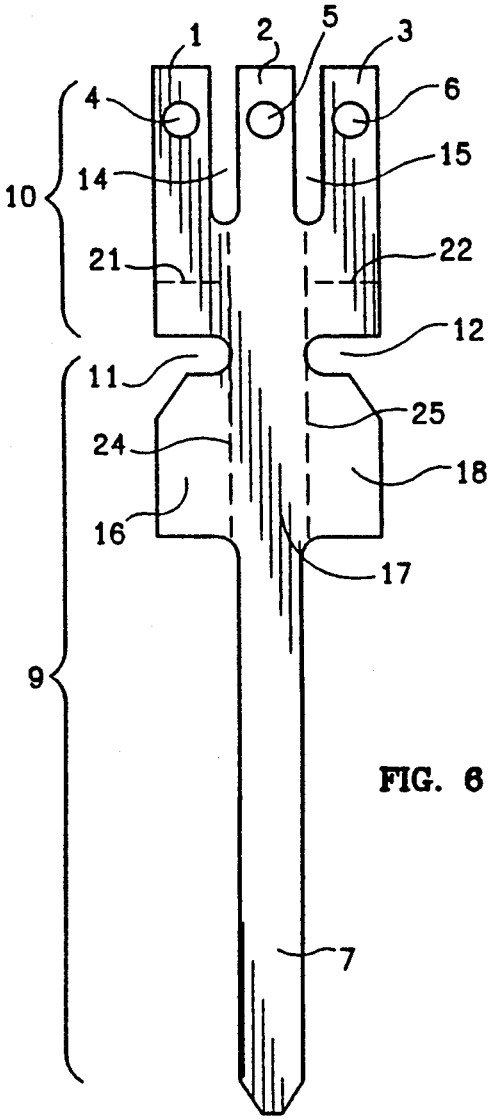
FIG. 6 is a top plan view of a socket contact blank illustrating the various methods of forming the preferred embodiment of the present invention.

Referring now to FIG. 6, a preferred method for making the present invention is illustrated. The socket contact blank is stamped from sheet metal stock. The main section 17 is stamped out of the stock at the same time that the retention stake 7 and contact beams 1, 2 and 3 are stamped and defined in the blank, and the contact dimples 4, 5, 6 are defined.

The preferred embodiment is formed by folding the flat blank along fold lines 24 and 25 so that the retention legs 16 and 17 form a generally U-shaped configuration with the main section 17. The opposed contact beams 1, 3 are folded inwardly towards each other along transition lines 21 and 22, respectively, to form their initial flask shape.

Figure 7:
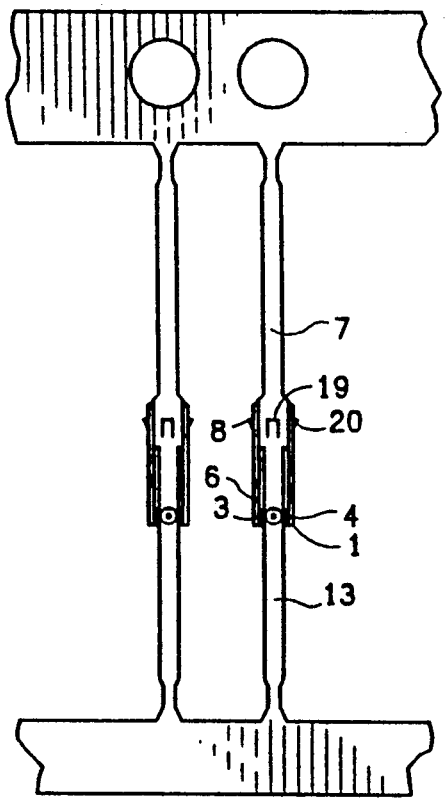
FIG. 7 is a top plan view of the preferred embodiment of the present invention shown on a carrier strip.

Referring now to FIG. 7, the preferred embodiment of the present invention is shown on a carrier strip as it would be used in a printed circuit board requiring 0.050 inch centerline spacing. In the preferred embodiment, the maximum distance between the outer periphery of the opposed contact beams 1 and 3 is 0.038 inches in order to fit within the confines of a connector shell having 0.050 inch centerline space. The simple structure of the present invention permits a reduced cavity size of the socket contact, thereby enabling socket contacts to be spaced such that they can be used in printed circuit boards requiring tight centerline spacing.

Thus, the independent opposed cantilevered contact beams 1 and 3 of the inventive structure, each with a contact dimple, provide efficient, reliable, and durable contact with an inserted pin 13 due to the torsional and bi-modal compressional moments of the opposed contact beams.

A number of embodiments of the present invention have been described. Nevertheless, it will be understood that various modifications may be made without departing from the spirit and scope of the invention. For example, the spacing contact beam 2 is not required for the principal embodiment of the invention to function properly. Thus, the spacing contact beam 2 could be removed during manufacture if desired. Accordingly, it is to be understood that the invention is not to be limited by the specific illustrated embodiment, but only by the scope of the appended claims.

I claim:

1. A method for producing an electrical socket contact for receiving an electrical contact pin, comprising the steps of:

a. stamping sheet metal stock to define at least one socket contact blank containing a support structure and two opposed cantilevered contact beams spaced apart by a spacing contact beam, each contact beam extending from the support structure to a pin-receiving end;

b. forming a retention means attaching to the support structure and extending opposite the pin-receiving end;

c. forming an embossment on each opposed contact beam adjacent and approximately equidistant from the pin-receiving end for contacting the outer diameter of a contact pin;

d. forming the opposed sides of the blank to form a U-shaped body;

e. folding the opposed contact beams toward each other along the axis of the U-shaped body such that the maximum distance between the embossments is less than the diameter of the contact pin, and such that the opposed contact beams are positioned to mechanically and electrically engage the inserted pin.

* * * * *